US009636939B1

(12) United States Patent
Ramirez

(10) Patent No.: US 9,636,939 B1
(45) Date of Patent: May 2, 2017

(54) ENVIRONMENTAL GREETING CARD

(71) Applicant: Vincent Ramirez, Montgomery, NY (US)

(72) Inventor: Vincent Ramirez, Montgomery, NY (US)

( * ) Notice: Subject to any disclaimer, the term of this patent is extended or adjusted under 35 U.S.C. 154(b) by 0 days.

(21) Appl. No.: 15/043,747

(22) Filed: Feb. 15, 2016

(51) Int. Cl.

| | |
|---|---|
| ***G09F 1/00*** | (2006.01) |
| ***B42D 15/08*** | (2006.01) |
| ***B42D 15/04*** | (2006.01) |
| *B42D 25/20* | (2014.01) |

(52) U.S. Cl.
CPC ..... *B42D 15/08* (2013.01); *B42D 15/042* (2013.01); *B42D 15/045* (2013.01); *B42D 25/285* (2014.10)

(58) Field of Classification Search
CPC ..... B42D 15/08; B42D 15/045; B42D 15/04; B42D 25/285
USPC ..... 40/124.09, 124.11
See application file for complete search history.

(56) References Cited

U.S. PATENT DOCUMENTS

| | | | | | |
|---|---|---|---|---|---|
| 2,168,920 | A * | 8/1939 | Wiasmann | B42D 15/08 | 229/80 |
| 3,523,638 | A * | 8/1970 | Moonan | B42D 15/08 | 229/92.1 |
| 4,973,087 | A * | 11/1990 | Balogh | B42D 15/045 | 283/117 |
| 5,135,157 | A * | 8/1992 | Cruz | B65D 27/34 | 229/314 |
| 5,232,087 | A * | 8/1993 | Schluger | B42D 15/045 | 206/232 |
| 5,366,145 | A * | 11/1994 | Sauerwine | B42D 15/08 | 229/304 |
| 5,626,551 | A * | 5/1997 | Kearns | B31B 47/00 | 206/232 |
| 5,645,214 | A * | 7/1997 | Taganas | B65D 27/34 | 229/313 |
| D421,457 | S * | 3/2000 | Crofton | D19/1 | |
| 6,135,506 | A * | 10/2000 | Chess | B42D 5/025 | 283/116 |
| 6,402,022 | B1 * | 6/2002 | Fabel | B41L 1/22 | 229/303 |
| 6,527,111 | B2 * | 3/2003 | Leung | B65D 5/422 | 206/232 |
| 7,127,844 | B2 * | 10/2006 | Collins | G09F 1/00 | 206/45.24 |
| 7,389,908 | B2 * | 6/2008 | Cohen | B65D 5/008 | 206/459.5 |
| 7,530,488 | B2 * | 5/2009 | Salerno | B42D 15/08 | 229/300 |
| 7,861,441 | B1 * | 1/2011 | Hoellwarth | B42D 15/08 | 229/92.8 |
| 8,875,886 | B2 * | 11/2014 | Brill | B65D 73/0028 | 206/461 |
| 2005/0055854 | A1 * | 3/2005 | Collins | G09F 1/00 | 40/124.16 |
| 2005/0204600 | A1 * | 9/2005 | Lauer | G06Q 99/00 | 40/594 |
| 2012/0018501 | A1 * | 1/2012 | Wilen | B42D 15/08 | 229/68.1 |

* cited by examiner

*Primary Examiner* — Shin Kim

(57) ABSTRACT

An environmental greeting card is constructed as a self-mailer and thus, eliminates the need for a separate envelope.

15 Claims, 5 Drawing Sheets

ENVIRONMENTAL GREETING CARD

TECHNICAL FIELD

The present invention relates to greeting cards and more specifically, relates to an environmental greeting card that is constructed as a self-mailer and thus, eliminates the need for a separate envelope.

BACKGROUND

As is well known, a greeting card is an illustrated piece of card or high quality paper featuring an expression of friendship or other sentiment, such as convey thanks or express sympathy for a loss or congratulations for an achievement, etc. While greeting cards are usually given on special occasions, such as, birthdays, Christmas or other holidays, they are also sent to express other feelings as mentioned above. Greeting cards are usually packaged with an envelope and come in a variety of different styles and different sizes. Traditionally, the shape of greetings cards is complementary to a rectangular shaped envelope for mailing purposes.

The envelope thus serves to protect and permit mailing of the greeting card which is inserted and contained within the envelope. Once the recipient receives the greeting card in the mail or in person, the recipient opens and discards the envelope. Thus, the envelope constitutes waste.

SUMMARY

An environmental greeting card is constructed as a self-mailer and thus, eliminates the need for a separate envelope.

In one embodiment, an environmentally friendly greeting card includes a greeting card template having a first fold line that partitions the template into first and second portions. The greeting card includes peripheral edging that extends around a complete periphery of the greeting card template and is separable therefrom by a continuous perforation that extends around the complete periphery of the greeting card. Adhesive edging extends around the peripheral edging that surrounds the second portion of the template. The adhesive edging is integral to the peripheral edging with fold lines separating the adhesive edging from the peripheral edging. The adhesive edging has an adhesive material along a surface thereof.

The adhesive edging is disposed along three sides of the second portion and is configured such that when the first portion is folded along the first fold line into an overlapping position with the second portion. The adhesive edging is configured to fold inwardly on top of the peripheral edging that surrounds three sides of the first portion of the greeting card template.

BRIEF DESCRIPTION OF THE DRAWING FIGURES

DETAILED DESCRIPTION OF CERTAIN EMBODIMENTS

In accordance with the present invention, an environmental greeting card 100 is provided and is of a self-mailer type that requires no separate envelope for delivery and/or mailing. The environmental greeting card 100 can be and is preferably made of 100% recycled paper content and any printing which is applied to the card can be done in an environmentally friendly ink, such as a soybean ink or other similar ink. As will be appreciated in view of the below description, the environmental greeting card 100 can include a preprinted message and be sold in a retail setting (retail store) besides traditional cards. In addition, the card 100 can be sold in other places, such as airports, and a dispensing machine for dispensing the card can also include a "live" postage application for applying postage to the card prior to dispensing. For example, a kiosk can be used for purchasing the card and applying the postage.

Figure 1:
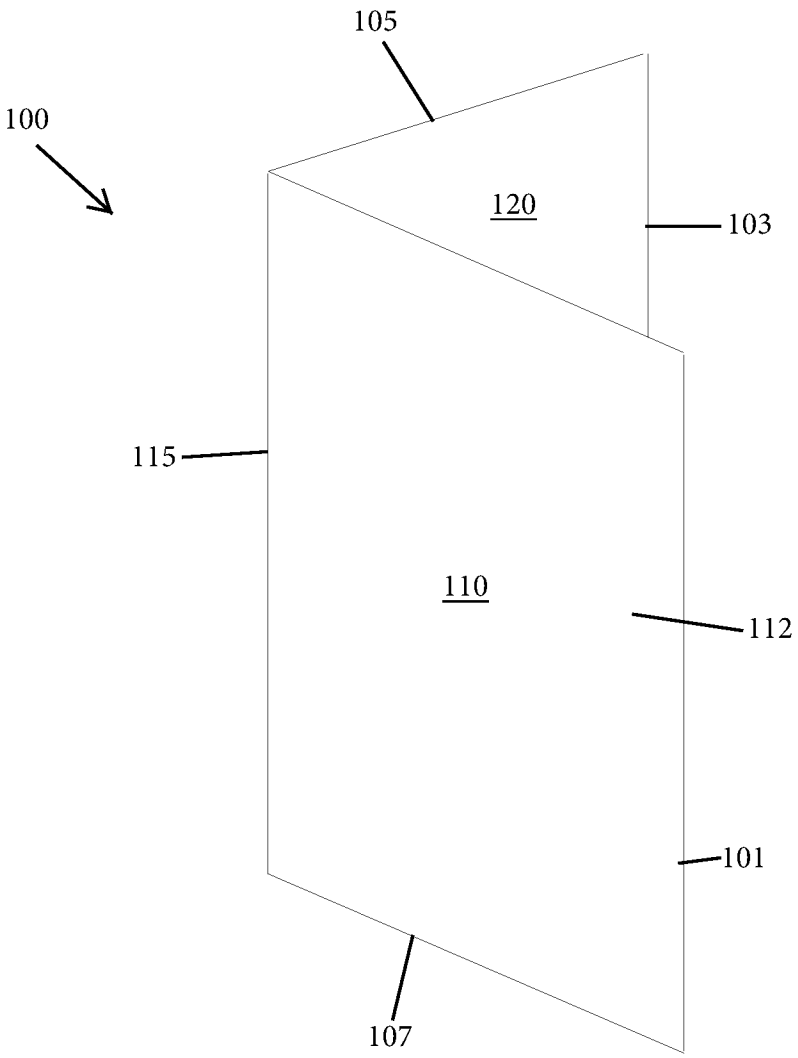
FIG. 1 is a front perspective view of an environmental greeting card in accordance with one embodiment of the present invention.
Figure 2:
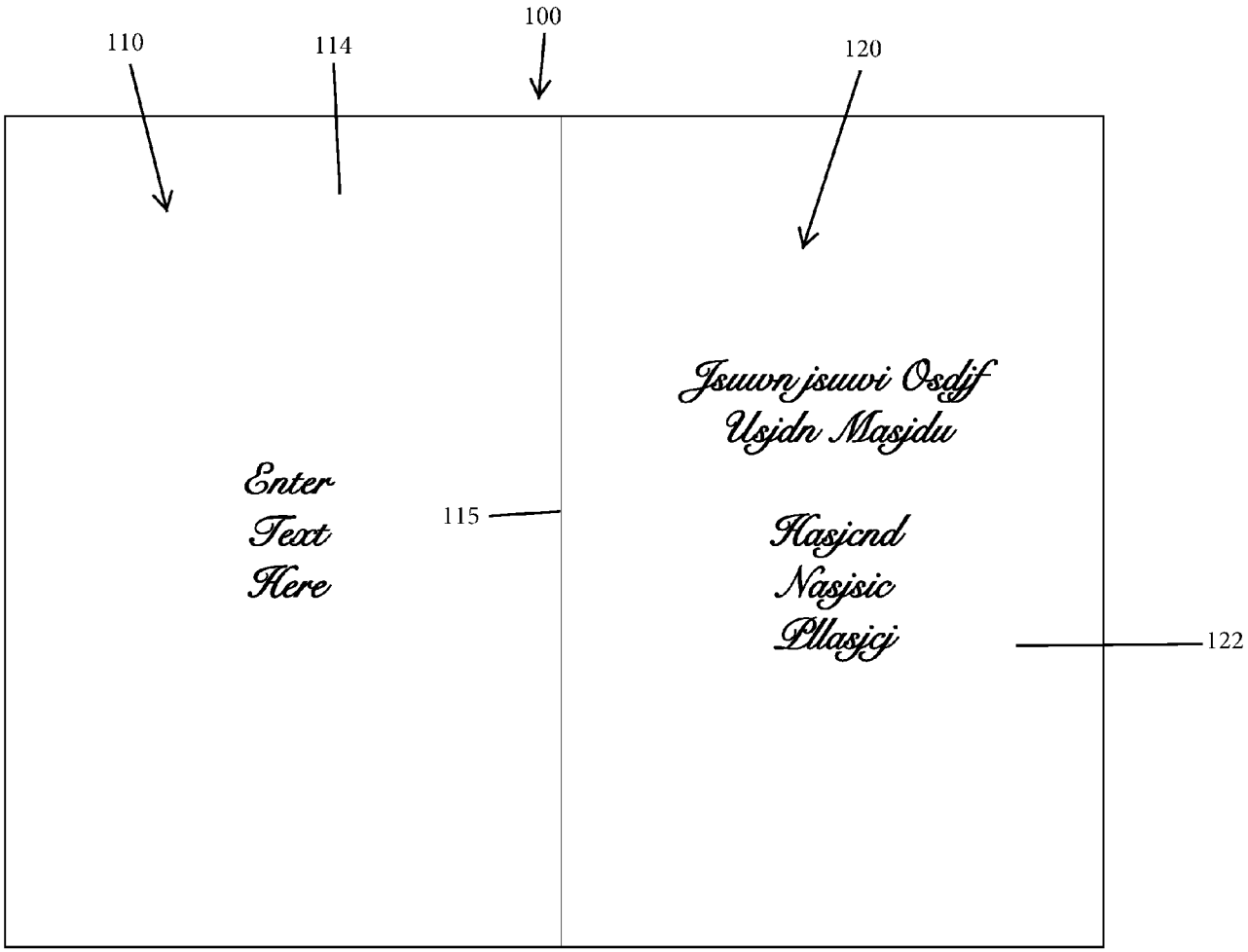
FIG. 2 is an elevation view of inner faces of the greeting card.
Figure 3:
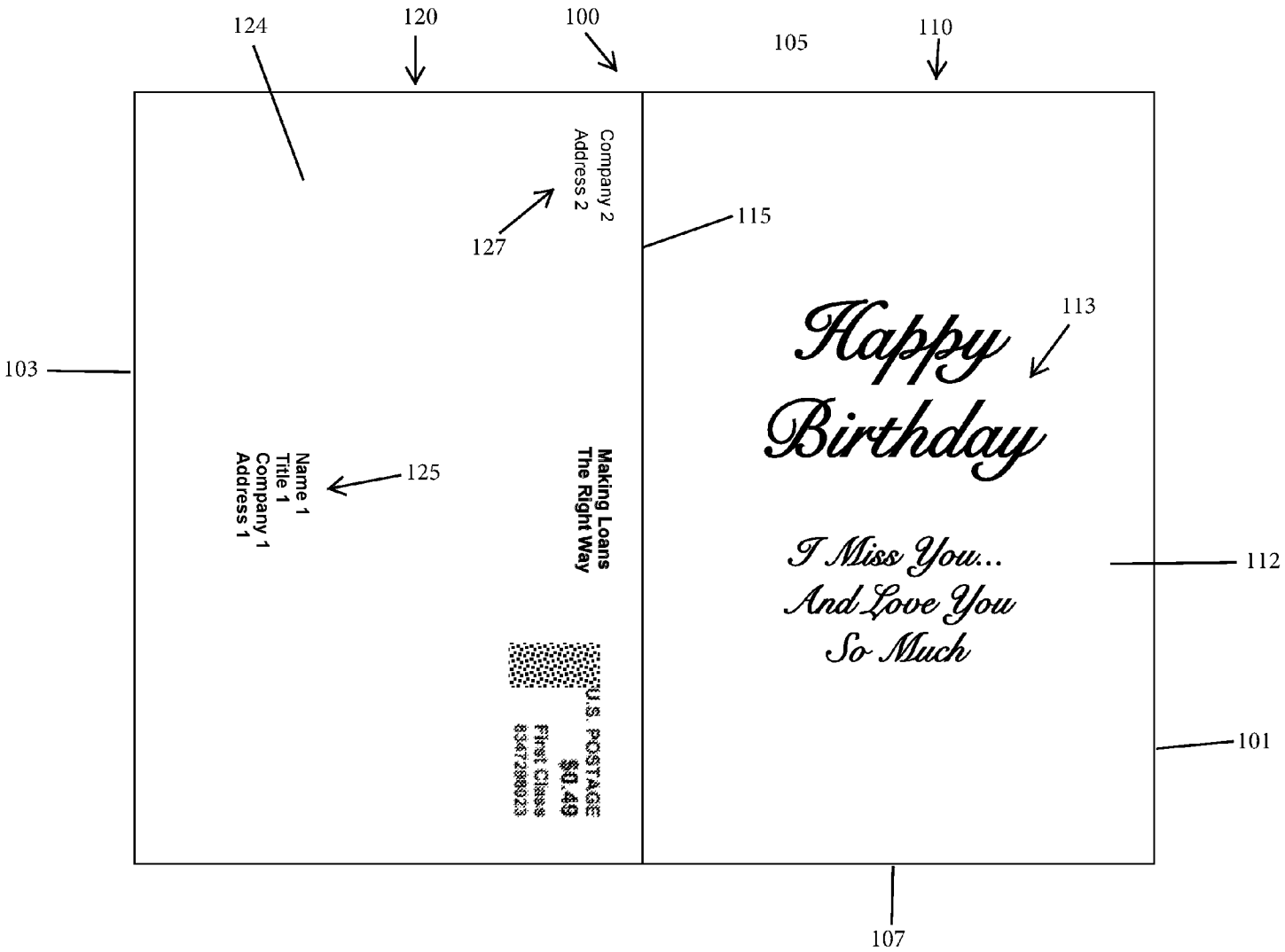
FIG. 3 is an elevation view of front and rear faces of the greeting card.

FIGS. 1-3 show an environmental greeting card 100 in accordance with one embodiment of the present invention. The greeting card 100 has a first portion 110 and a second portion 120 adjacent the first portion 110 with a fold line 115 defined therebetween. The first portion 110 defines a front of the greeting card 100, while the second portion 120 defines a rear of the greeting card 100. It will be appreciated that the first portion 110 has a first face 112 and a second face 114. The first face 112 represents the front of the first portion and the front surface of the greeting card 100 and the second face 114 represents the backside of the first portion and represents a first inner surface of the greeting card 100. Similarly, the second portion 120 has a first face 122 and a second face 124. The first face 122 represents the front of the second portion 120 and a second inner surface of the greeting card 100 and the second face 124 represents the backside of the second portion 120 and represents the back (rear) surface of the greeting card 100. The first and second portions 110, 120 thus represent panels of the card 100.

Typically, the first and second portions 110, 120 have equal footprints and can be rectangular shaped. When the first and second portions 110, 120 have equal footprints, the portions 110, 120 can be thought of as being halves of the greeting card 100. It will also be appreciated that all faces 112, 114, 122, 124 can contain text and/or graphics.

As shown in FIG. 2, the faces 114, 122 define the inner faces of the greeting card 100 on which one or more signatures are typically placed. FIG. 3 shows the faces 112, 124 with the face 112 having a front message 113 and the face 124 containing address information. In particular, the address information includes a recipient mailing address 125 and a return (sender) address 127.

Figures 4, 5:
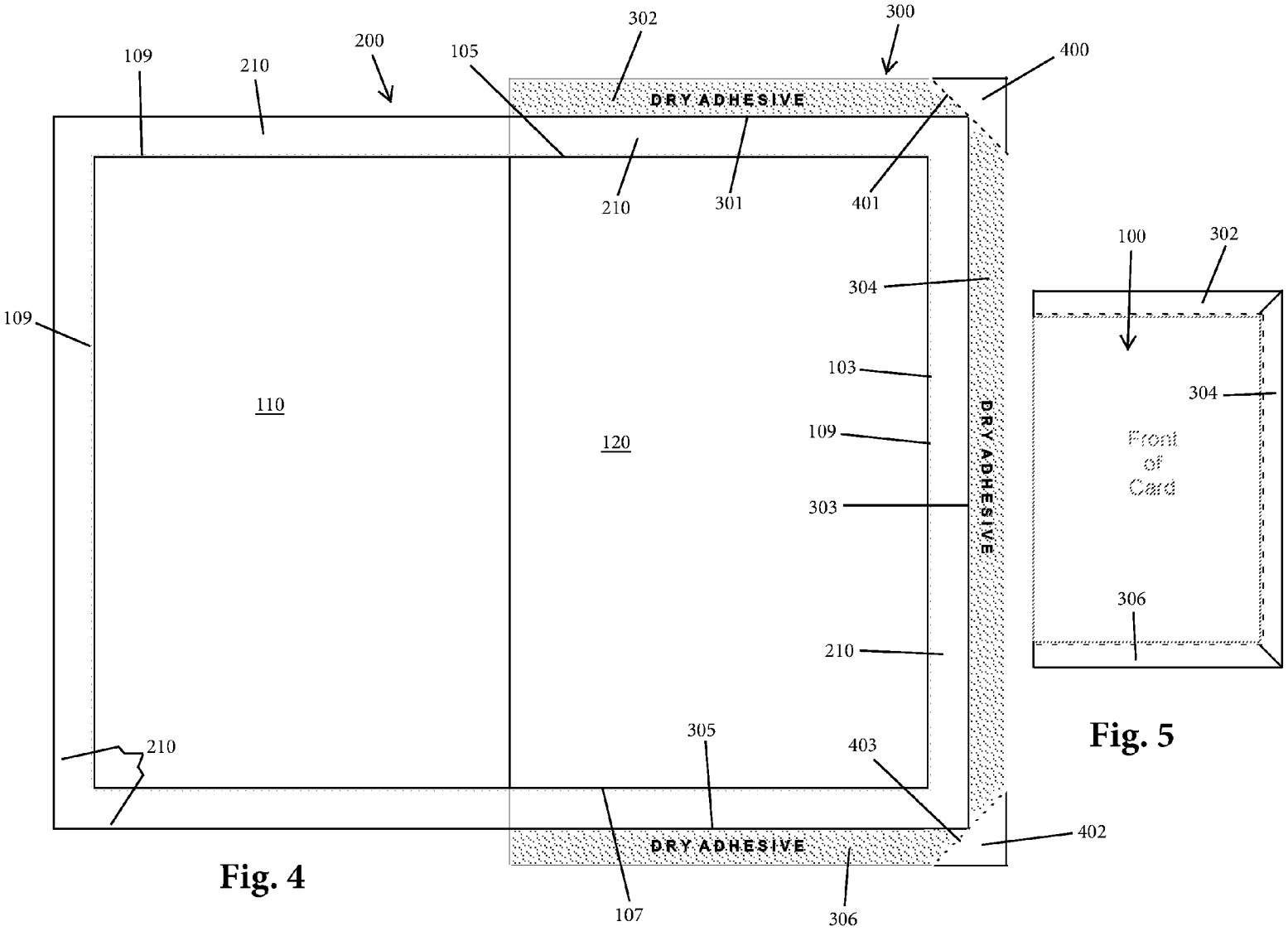
FIG. 4 is a front view of a blank, in a fully open position, for forming the environmental greeting card of FIG. 1.
FIG. 5 is front view of the greeting card in a self-mailer format after the panels of the greeting card blank are folded over and selectively bonded to one another.
Figure 6:
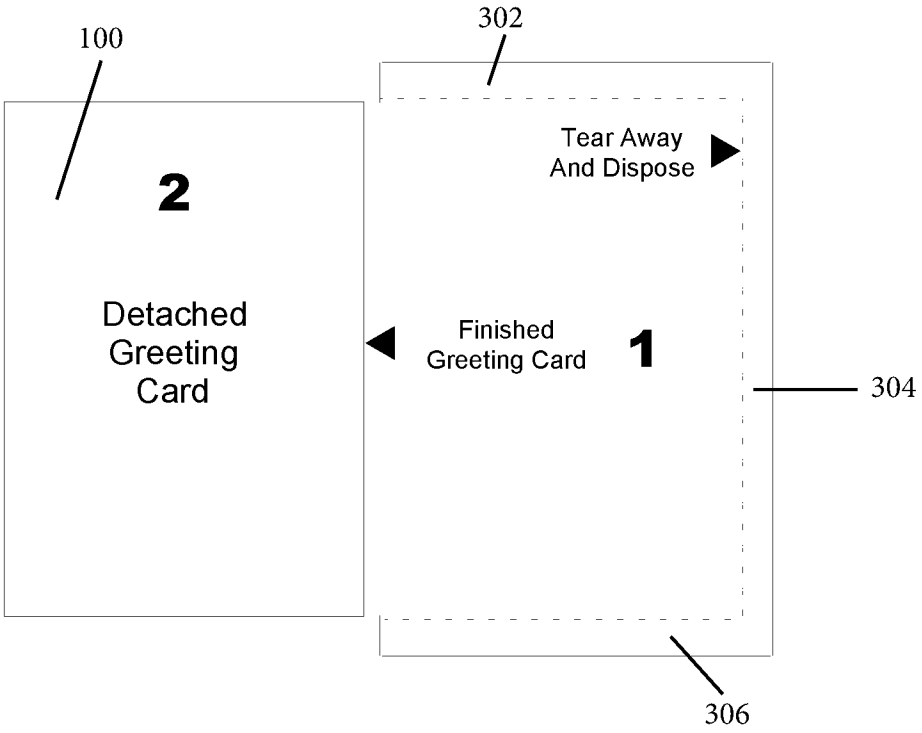
FIG. 6 shows the separation of the border section from the greeting card after receipt by an individual.

FIG. 4 shows a blank 200, in a fully open position, for forming the environmental greeting card 100 of FIG. 1. The blank 200 includes the greeting card 100 itself (which can also be thought of as being a greeting card template) and also includes a removable border section that consists of removable peripheral edging 210 and adhesive edging 300 that is integral to and extends outwardly from the removable peripheral edging 210.

In the open position of the blank 200 of FIG. 4, the inner surfaces (i.e., the second face 114 and the first face 122) of the greeting card 100 are shown. Fold line 115 is also shown. In the open position, the greeting card 100 thus contains a first edge 101 defined at the free end of the first portion 110; a second edge 103 defined at the free end of the second portion 120; a top edge 105; and an opposing bottom edge 107. The top edge 105 extends across the first and second portions 110, 120 and similarly, the bottom edge 107 extends across the first and second portions 110, 120.

The peripheral edging 210 extends around the complete periphery of the greeting card 100 and it attached to the greeting card 100 by perforations 109 as shown in the figure. As shown in the open position of FIG. 4, the perforations 109 define a rectangle. The formation of perforations 109 allow the peripheral edging 210 to be easily separated and removed from the greeting card 100. As shown, the peripheral edging 210 has a width so as to create a frame-like structure around the greeting card 100.

The blank 200 further includes the adhesive edging 300. Unlike the peripheral edging 210, the adhesive edging 300 does not extend around the complete periphery of the greeting card 100. Instead, the adhesive edging 300 is located along select edges of the peripheral edging 210. More specifically, the adhesive edging 300 is configured to adhesively bond the first portion 110 to the second portion 120 to allow for the safe mailing and/or transportation of the signed greeting card without the use of a separate envelope as discussed herein.

As shown, the adhesive edging 300 comprises a first section 302 that extends along the top edge 105 of the second portion 120; a second section 304 that extends along the second edge 103 of the second portion 120; and a third section 306 that extends along the bottom edge 107 of the second portion 120. The first, second, and third sections 302, 304, 306 are not removable from the corresponding sections of the peripheral edging 210. Instead, there are a series of fold lines that define the two corresponding adjacent sections. More specifically, a first fold line 301 separates the first section 302 and the corresponding section of the peripheral edging 210 and permits the first section 302 to fold relative to the peripheral edging 210. A second fold line 303 separates the second section 304 and the corresponding section of the peripheral edging 210 and permits the second section 304 to fold relative to the peripheral edging 210. A third fold line 305 separates the third section 306 and the corresponding section of the peripheral edging 210 and permits the third section 306 to fold relative to the peripheral edging 210. One surface of each of the first, second and third sections 302, 304, 306 contains a dry adhesive.

In another aspect to the present invention, the blank 200 includes a pair of corner tear sections 400, 402 which form part of the adhesive edging 300 prior to tearing these sections 400, 402 away from the remaining portions of the adhesive edging 300. A first perforation 401 connects the corner section 400 to the adjacent sections of the adhesive edging 300 and a second perforation 403 connects the corner section 402 to the adjacent sections of the adhesive edging 300. The perforations 401, 403 permit the corner sections 400, 402 to be easily torn away from the rest of the blank 200.

The corner sections 400, 402 form a part of the blank 200 to allow the blank 200 to be fed into and processed by a traditional laser or inkjet printer. Traditional printers typically feed paper by advancing the sheet along a print path defined by rollers, etc., and the presence of the corner sections 400, 402 allows for the blank 200 to be pulled (advanced) through the printer when applying print (such as a message and/or graphics) to the greeting card template of the blank 200.

As will be appreciated by viewing FIG. 4, the elimination of the right angled shaped corner sections 400, 402 results in the first, second, and third sections 302, 304, 306 being distinct and separate from one another. Thus, each of the first, second, and third sections 302, 304, 306 can be individually folded to seal the free edges of the blank when the first portion 210 is folded over the second portion 220 to create the mailer for the greeting card 100.

The removal of the corner section 400 defines beveled edges at first ends of the first and second section 302, 304 and removal of the corner section 402 defines beveled edges at the second end of the second section 304 and the first end of the third section 306. The second end of the first and third sections 302, 306 can be flat edges as opposed to being beveled edges. This results since each perforation 401, 403 intersections the corner defined by the peripheral edging 210 in the respective two corners of the blank 200.

The formation of the two adjacent beveled edges in the two corners allow for inward folding of the sections 302, 304, 306 without having any significant overlap of the sections 302, 304, 306. In other words, when the sections 302, 304, 306 are folded inwardly the beveled edges abut one another and create a right angle that overlies the right angle formed by the peripheral edging 210. Thus, when the first, second and third sections 302, 304, 306 are folded inwardly, they overlap and at least substantially mirror the three sections of the peripheral edging 210 of the first portion 210 that is folded over the second portion 220 prior to folding over the adhesive sections 302, 304, 306.

FIG. 5 shows the greeting card 100 after folding the first portion 210 over the second portion 220 and sealing it with the adhesive sections 302, 304, 306.

In this manner, the first portion 210 is securely attached to the second portion 220 to create the mailer and allow for a person to mail the greeting card 100. As shown, the tearable peripheral edging 210 and the adhesive edging 300 extend around three sides of the greeting card mailer with the fourth side being defined only by the fold line 115 between the first and second portions 110, 120.

When the recipient receives the mailer, the recipient tears along the three perforated areas which results in separation of the peripheral edging 210 and the adhesive edging 300 from the greeting card 100. This results in the intact greeting card 100 being left behind, while the joined peripheral edging 210 and the adhesive edging 300 can be discarded.

The greeting card 100 is environmentally friendly since it eliminates the need for a separate envelope and instead provides an integral mailing solution in the form of a self-mailer.

In yet another aspect of the present invention, the greeting card blank 200 can be thought of as including a greeting card template and a tearable perforated border section that includes foldable adhesive edging which is configured to adhesively bond to one half of the greeting card blank 200 that is folded on top of the other half so as to create a self-mailer greeting card. Once received, the recipient separates the border section by tearing along the perforated lines resulting in only the greeting card template remaining.

The invention is described in detail with reference to particular embodiments thereof, but the scope of the invention is to be gauged by the claims that follow and also by those modifications that provide equivalent features to those that are claimed as such modifications are still within the spirit and scope of the invention.

What is claimed is:

1. An environmentally friendly greeting card comprising:

a greeting card template having a first fold line that partitions the template into first and second portions;

peripheral edging that extends around a complete periphery of the greeting card template and is separable therefrom by a continuous perforation that extends around the complete periphery of the greeting card;

adhesive edging that extends around the peripheral edging that surrounds the second portion of the template; the adhesive edging being integral to the peripheral edging with fold lines separating the adhesive edging from the peripheral edging, the adhesive edging having an adhesive material along a surface thereof;

wherein the adhesive edging is disposed along three sides of the second portion and is configured such that when the first portion is folded along the first fold line into an overlapping position with the second portion, the adhesive edging being configured to fold inwardly on top of the peripheral edging that surrounds three sides of the first portion of the greeting card template.

2. The environmentally friendly greeting card of claim 1, wherein the first and second portions are mirror images to one another.

3. The environmentally friendly greeting card of claim 1, wherein the peripheral edging comprises a first section along a top edge of the second portion; a second section that extends along a free edge of the second portion; and a third section that extends along a bottom edge of the second portion.

4. The environmentally friendly greeting card of claim 3, wherein the adhesive edging comprises a first section that extends along the first section of the peripheral edging and is separated therefrom by a second fold line; a second section that extends along the second section of the peripheral edge and is separated therefrom by a third fold line; and a third section extends along the third section of the peripheral edge and is separated therefrom by a fourth fold line.

5. The environmentally friendly greeting card of claim 1, wherein the adhesive edging includes first and second tearable corner sections located proximate first and second corners of the second portion of the greeting card template.

6. The environmentally friendly greeting card of claim 5, wherein the first and second tearable corner sections are defined first and second corner perforations.

7. The environmentally friendly greeting card of claim 6, wherein each of the first and second corner perforations comprises a perforated line that intersects a corner formed by peripheral edging.

8. The environmentally friendly greeting card of claim 7, wherein the first corner perforation defines a first beveled end edge of a first section of the adhesive edging that extends along a top section of the peripheral edge along the second portion of the greeting card template and a second beveled end edge of a second section of the peripheral edge that is at a right angle to the first section of the peripheral edging, wherein the second corner perforation defines a third beveled end edge of a third section of the adhesive edging that extends along a bottom section of the peripheral edging along the second portion of the greeting card template and a fourth beveled end edge of the second section of the peripheral edging that is at a right angle to the third section of the peripheral edging.

9. The environmentally friendly greeting card of claim 8, wherein the first and second beveled end edges are co-linear.

10. The environmentally friendly greeting card of claim 8, wherein when the first, second and third sections are folded inwardly along respective fold lines, the first and second beveled end edges abut one another, the third and fourth beveled end edges abut one another.

11. The environmentally friendly greeting card of claim 8, wherein ends of the first and third sections closer to the first fold line and opposite the first and third beveled end edges.

12. The environmentally friendly greeting card of claim 1, wherein the greeting card template, peripheral edging and adhesive edging are formed of a paper material.

13. The environmentally friendly greeting card of claim 1, wherein the adhesive material comprises a dry adhesive.

14. An environmentally friendly greeting card comprising:

a greeting card template having a first half and a second half separated by a first fold line; and a removable border section that is connected to the greeting card template along a periphery thereof by a continuous perforated structure, the border section including a main section that completely surrounds the greeting card template and adhesive edging that extends outwardly from the main section and is disposed only about three sides of the second half of the greeting card template, the adhesive edging including sections that are foldable relative to the main section and include adhesive on surfaces thereof;

wherein the environmentally friendly greeting card comprises a self-mailer that is defined by the removable border section and in a mailing state, the first half is folded over the second half and the sections of the adhesive edging are folded over and into adhesive bonding contact with the main section that surrounds three sides of the first half and whereupon removal of the border section by rupturing the perforated structure produces the greeting card which is in the form of the greeting card template.

15. The environmentally friendly greeting card of claim 14, wherein the removable border section comprises a tearable structure.

* * * * *